United States Patent [19]

Copeland

[11] Patent Number: 4,626,858

[45] Date of Patent: Dec. 2, 1986

[54] ANTENNA SYSTEM

[75] Inventor: William O. Copeland, Huntsville, Ala.

[73] Assignee: Kentron International, Inc., Huntsville, Ala.

[21] Appl. No.: 481,361

[22] Filed: Apr. 1, 1983

[51] Int. Cl.[4] ..... H01Q 3/02; H01Q 3/12

[52] U.S. Cl. ..... 342/374; 455/277; 342/363

[58] Field of Search ..... 343/374, 363, 362, 754, 343/911 L; 455/277

[56] References Cited

U.S. PATENT DOCUMENTS

| | | | |
|---|---|---|---|
| 3,209,355 | 9/1965 | Livingston | 343/362 |
| 3,487,413 | 12/1969 | Shores . | |
| 3,622,888 | 11/1971 | Charvier et al. | 343/362 |
| 3,670,275 | 6/1972 | Kalliomaki et al. | 455/277 |
| 3,720,888 | 3/1973 | Manuali | 343/374 |
| 3,757,333 | 9/1973 | Procopio . | |
| 3,827,055 | 7/1974 | Bogner et al. . | |
| 3,833,909 | 9/1974 | Schaufelberger . | |
| 3,852,761 | 12/1974 | Bogner . | |
| 3,922,680 | 11/1975 | Alsberg et al. . | |
| 3,993,999 | 11/1976 | Hemmi et al. . | |
| 3,996,592 | 12/1976 | Kline et al. | 455/277 |
| 4,170,759 | 10/1979 | Stimple et al. | 455/277 |
| 4,257,050 | 3/1981 | Ploussios . | |
| 4,268,831 | 5/1981 | Valentino et al. . | |
| 4,288,795 | 9/1981 | Shelton . | |
| 4,335,388 | 6/1982 | Scott et al. . | |
| 4,348,678 | 9/1982 | Thomas . | |
| 4,359,741 | 11/1982 | Cassel | 343/754 |
| 4,538,153 | 8/1985 | Taga | 455/277 |

FOREIGN PATENT DOCUMENTS

| | | | |
|---|---|---|---|
| 58-80939 | 5/1983 | Japan | 455/277 |

*Primary Examiner*—Theodore M. Blum
*Attorney, Agent, or Firm*—Sigalos & Levine

[57] ABSTRACT

A system for receiving signals from spatial objects comprising an array fed aperture antenna for producing multiple beam patterns covering a predetermined spatial volume a corresponding feed port for each beam pattern coupled to said array for producing an output when a signal is generated by an object within a corresponding beam pattern, a receiver for receiving the antenna array feed port outputs, and means coupled between the antenna array feed ports and the receiver for automatically coupling only the output of the feed port producing the greatest power to the receiver whereby automatic and continuous reception of signals from an object within the multiple beam pattern is accomplished. In addition, the invention relates to coherent summing of various combinations of the feed port outputs to provide a variable beam width pattern.

39 Claims, 11 Drawing Figures

ANTENNA SYSTEM

The Government has rights in this invention pursuant to Contract No. DASG60-82-C-0002 awarded by The Department of the U.S. Army, Ballistic Missile Defense Systems Command, Huntsville, Ala. 35807.

BACKGROUND OF THE PRESENT INVENTION

The present invention relates to an antenna system and in particular to a telemetry antenna system using a lightweight Luneberg lens as the aperture.

It is especially important in todays technology to be able to receive a signal emitting from a spatial object such as a target within a particular predetermined spatial volume. For instance, re-entry ballistic missiles transmit telemetry data, tracking data and impact location data for strategic missile testing. Such data can be collected from a variety of airborne objects or vehicles. Further, it is important to gather navigation data from satellite-to-ground stations such as mobile vehicles or ships and the like. In addition, fixed position satellites require ground stations that must receive data from more than one satellite simultaneously. Also, in border surveillance it is necessary to cover a wide area and detect anything that moves within a volume that includes that particular area.

In a system for receiving telemetry data during the terminal phase of a re-entry vehicle (RV) for missile targeting, it is important to have a spatial volume covered or scanned that is wide in azimuth but narrow in breadth or elevation so that a system that is airborne may focus on a predetermined volume along the horizon and detect and locate any RVs re-entering that particular volume. Further it is important in an airborne system that it be a nonphysical scanning telemetry antenna system because the system has to be operated from an aircraft where physical movement of the antenna would be extremely limited. A desired sector volume coverage would include an area of 11° to 12° in elevation and 45° in azimuth. Further, in such system it is important that the angular or azimuth coverage be achieved in at least two modes of operation. The first mode is a combined feed mode for which a wide, single fan beam will be formed by the coherent summing of all of the feeds and secondly a switched feed mode for which narrow, individual, but overlapping, beams will be formed.

In addition, the antenna system must receive and process the entire operating band, in this case 2200 to 2300 MHz, to determine the antenna beam containing the strongest signal without knowledge of the frequency channel being used by the transmitting carrier within the operating band. Since there are a large number of channels within the telemetry band, the antenna system, in the automatic mode, must perform its automatic beam switching function without a prior knowledge of the telemetry frequency channel to be used for a particular mission or the assignment of the frequency channel for a particular airborne object such as a re-entry vehicle.

Electronically scanned arrays could meet such requirements but are extremely expensive and have many undesirable features. For instance, in the U.S. Pat. No. 3,487,413 to M. W. Shores, antenna elements are grouped in parallel column fashion and firmly attached to a Luneberg lens over an arc which is approximately equal to ½ the desired "look" angle. Elements of the array are energizable in accordance with a programmed sequence. Thus it provides a sequential, not simultaneous, lobe coverage of wide angles by means of programmed switching of element feeds one at a time. Further, the antenna may be mechanically rotated to a desired position by way of an axle extending axially through the Luneberg sphere in order to provide a full hemispherical look angle.

A Butler matrix coupled to a planar array of coherently summed elements in the vertical rows could possibly also meet the requirements but again the cost and problems including the difficulty of achieving better side lobes than that produced by uniform illumination are not acceptable. A fixed paraboloid reflector aperture with multiple feeds to achieve azimuth coverage and a method of switching the feed to obtain the maximum gain of the aperture when required is also possible. However, with four or more S-band orthogonal mode feeds in front of a 30 inch diameter paraboloid reflector and even with the size reduction of the feeds brought about by dielectric loading, the aperture blockage remains prohibitive. A feed system offset from half of a paraboloid reflector could be used but the problem associated with illuminating the reflector from other than its focal point is significant as is the feed and reflector development that is required.

A lightweight Luneberg lens was discovered to be the ideal aperture configuration especially for airborne telemetry antenna system applications. The Luneberg lens is a spherical dielectric lens made with stepped dielectric constant materials which vary radially in dielectric constant from 2 at the center to 1 at the surface. For the true Luneberg lens, the focal point is on the back surface of the lens which is away from the signal source. A common version of the Luneberg lens (referred to some times as a Morgan lens) is one whose design has been modified slightly to make the focal points fall on a spherical surface just off the lens surface to facilitate coupling to the phase center of the feed system. A significant advantage of the use of the spherical dielectric lens, particularly for small apertures, is that feed blockage of the apertures is eliminated. Also, all feeds can be placed of focal points of the spherical lens aperture. All feed beams are also on the boresight of the aperture and, therefore, do not have the gain reduction present for off-boresight beams of phased array antennas. In addition, simple feeds such as open-ended wave guides produce ideal low sidelobe antenna patterns.

By testing different available feeds, it was concluded that a 44° azimuth coverage and 11° elevation coverage could be obtained from a 30-inch Luneberg lens by simultaneously and coherently summing the outputs of four feeds. This gives a gain reduction of about six dB relative to a single feed in order to obtain the fourfold increase in azimuth beam width.

It was found necessary, if the gain was to be kept above 20 dB, that beam switching must be employed using a unique technique that determines in which feed the beam object or target is located.

Thus the novel antenna system design uses a 30-inch diameter lightweight Luneberg lens equipped with four feeds in the azimuth plane at the equator to achieve single beam patterns or selective multiple beam patterns. The feeds are quad-ridged circular devices with orthogonal linear polarization outputs which are converted to simultaneous left and right-hand circular polarization using 90° hybrid couplers. The operator may manually select any one of four single beams covering 11° azimuth by 11° elevation, two beams combined for 22° azimuth by 11° elevation sector coverage, or four beams combined for 44° azimuth by 11° elevation sector coverage. An automatic mode permits the full gain of a single beam (about 22 dB) to be attained and switches automatically to the RF feed containing the greatest signal in the 44° by 11° sector. Information for the automatic switching is achieved by comparing the signal power output from radiometer receivers coupled to each feed. If desired, one may be used for each orthogonal polarization output for each of the four antenna feeds. The automatic RF switching is achieved by PIN-diode switches in ten nanoseconds.

Further, the output of the feed ports are coupled to gain and phase matched Gallium Arsenide (GaAs) FET low noise preamplifiers (LNA's) through external limiters. The limiters protect the LNA's against accidental RF input of up to six watts average power. The amplification prior to the 90° hybrid couplers, used to convert the two orthogonal polarizations to left and right-hand circular polarizations, substantially reduces the noise figure contribution that would otherwise be associated with the insertion loss of the hybrids. Directional couplers are used to divert a tenth of the power from both horizontal and vertical polarization outputs from each feed channel to the radiometer receivers. These receivers have a 120 MHz predetection RF bandwidth to assure that the signal amplitude is sufficient at the band edges of the 2200 to 2300 MHz telemetry band. The output cf the radiometers is fed to comparators and logic circuitry which select the feed with the most signal power and produce outputs which drive a $1\times6$ PIN-diode switch to select the feed which produces the greatest signal. The PIN-diodes switch the RF signal in ten nanoseconds. This switching time is small compared to the width of the PCM pulses received. Therefore, decommutation equipment will not miss a single bit during the automatic hand over from one feed beam to another. The use of the PIN-diodes and two-way and four-way combiners achieve four modes of operation. These modes include selection of any one beam, selection of two coherently summed beams, four coherently summed beams, and automatic switching from one beam to another.

Thus, the present invention uses a Luneberg lens aperture for producing multiple beam patterns covering a predetermined spatial volume and in which coherent combining of the antenna feed outputs is utilized to vary beam width and in which automatic scanning of the multiple beams may be accomplished to lock on to the beam containing the signal from a spatial object.

The novel invention utilizes control means coupled to the outputs of each of the antenna feeds for determining which of the feeds is producing the greatest power output and generating a corresponding control signal which is utilized by a switching network to enable coupling to the receiver only the output from the feed producing the greatest power.

SUMMARY OF THE INVENTION

Thus the present invention relates to a system for receiving signals from spatial objects comprising an array fed aperture antenna for producing multiple beam patterns covering a predetermined spatial volume, a corresponding feed port for each beam pattern coupled to said array for producing an output when a signal is generated by an object within a corresponding beam pattern, a receiver for receiving said antenna array feed port outputs, and means coupled between said antenna array feed ports and said receiver for automatically coupling only the output of the feed port producing the greatest power to said receiver whereby automatic and continuous reception of a signal from an object within said multiple beam pattern is accomplished.

The novel invention also relates to a method of receiving signals from spatial objects comprising the steps of producing multiple beam patterns from an antenna array for covering a predetermined spatial volume, producing an output signal from a corresponding feed port for each beam pattern when a signal is generated by an object within a corresponding beam and automatically switching only the output of the feed port producing the greatest power to a receiver whereby automatic and continuous reception of a signal from an object within said multiple beam pattern is accomplished.

The present invention also relates to a method of receiving signals from airborne targets comprising the steps of producing multiple beam patterns from an antenna array for covering a predetermined spatial volume, producing an output signal from a corresponding feed port for each beam pattern when a signal is generated by an object within a corresponding beam, and providing an automatic mode and a manual mode of operation including, in the automatic mode, automatically switching only the output of the feed port producing the greatest power to a receiver whereby automatic and continuous reception of a signal from an object within said multiple beam pattern is accomplished, and in the manual mode, selectively coupling any one, two or more coherently summed feed port outputs to said receiver whereby manual reception of a signal from an object within one, two or more of said beams is accomplished.

BRIEF DESCRIPTION OF THE DRAWINGS

These and other detailed objects of the present invention will be disclosed in the course of the following specification and drawings in which like elements are identified by like numerals and in which.

DETAILED DESCRIPTION OF THE DRAWINGS

Figure 1:
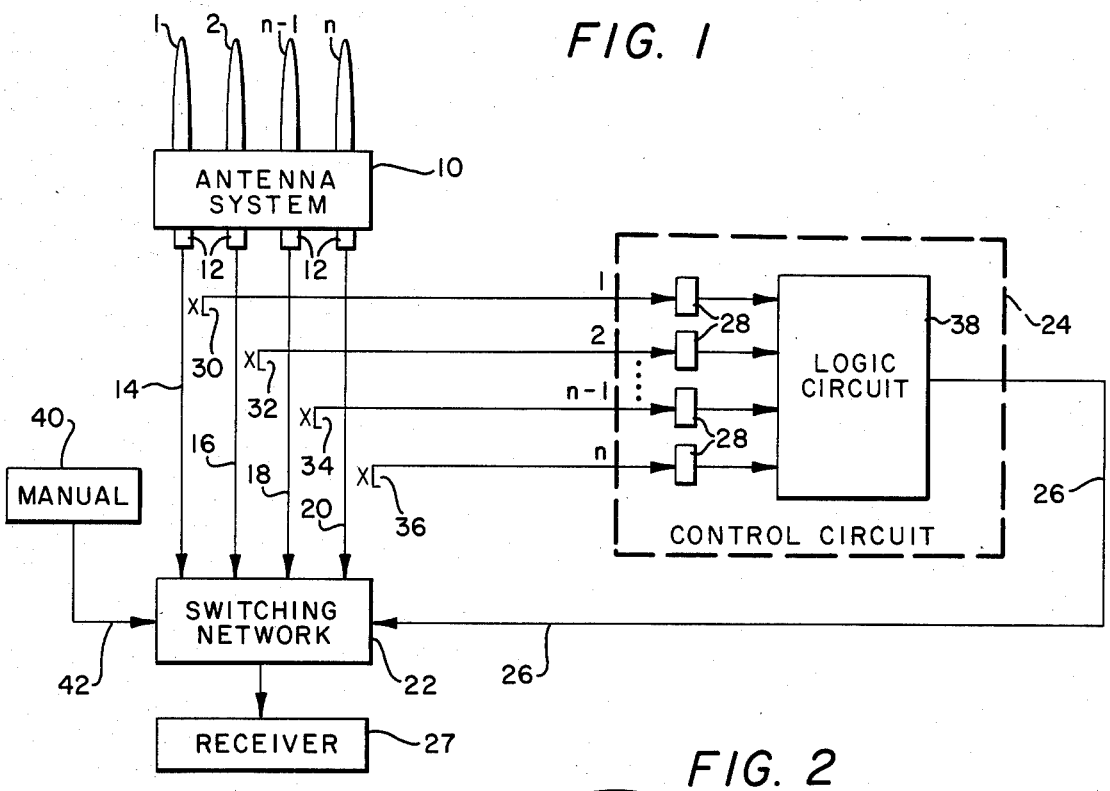
FIG. 1 is a schematic diagram of the novel invention for receiving signals from spatial objects such as airborne targets.

FIG. 1 is a schematic representation of the present invention in which an antenna system 10 produces a plurality of beam patterns 1 through n. For purposes of explanation that follows only four beam patterns will be discussed but, as indicated, n beam patterns could be involved. A corresponding number of feed ports 12 are mounted on said antenna system for receiving signals from each of the corresponding beams. The signals produced by these feed ports 12 are coupled via lines 14, 16, 18 and 20 to a switching network 22. A control circuit 24 monitors the outputs from the feed ports 12 and produces an output signal on line 26 which is coupled to switching network 22 where, in the automatic mode, the output of the feed port producing the greatest signal, that is the output from the feed port whose beam contains the spatial object such as a target, is coupled from the switching network 22 to a receiver 27. Control circuit 24 comprises a plurality of radiometer receivers 28 which are equal in number to the feed ports 12. These radiometers divert a small portion of the output power from the feed ports 12 and convert the power output to a DC level. The diversion of power is accomplished by the use of directional couplers 30, 32, 34 and 36 which divert a tenth of the power from each feed channel 14, 16, 18 and 20 to each corresponding radiometer receiver 28. A logic circuit 38 receives the DC power levels from the radiometers and compares them to determine which of the feed horns 12 is producing the greatest output power and therefore determines in which beam the spatial object or target is located. The logic circuit 38 then produces a signal on line 26 which is coupled to switching network 22 which couples only the output of the feed port 12 having the greatest power to receiver 27. This occurs in the automatic mode only. A manual control 40 is provided and is coupled via line 42 to switching network 22 where it overrides the automatic operation of control circuit 24 and enables any one of the outputs of feed ports 12 to be coupled to receiver 27 or coherently sums and combines any two adjacent outputs such as, for example only, the outputs on line 16 and 18 and couples the combined coherent output to receiver 27 or combines all of the outputs of feed ports 12 on lines 14, 16, 18 and 20 and couples the coherently summed and combined outputs to receiver 27 to provide a wide beam coverage.

Thus in the circuit as illustrated in FIG. 1, either an automatic operation or manual operation of the circuit can be obtained. In the automatic mode, the switching network 22 and control circuit 24 operate together to automatically couple the output of the feed port 12 producing the greatest power to the receiver 27 whereby automatic and continuous reception of a signal from an object within the multiple beam pattern is accomplished. In the manual mode, the automatic circuitry is overridden and the operator can manually select 1, 2 or all of the outputs of the feed ports 12 which are coherently summed and combined and the output coupled to the receiver so that a selected beam pattern may be observed.

Figure 2:
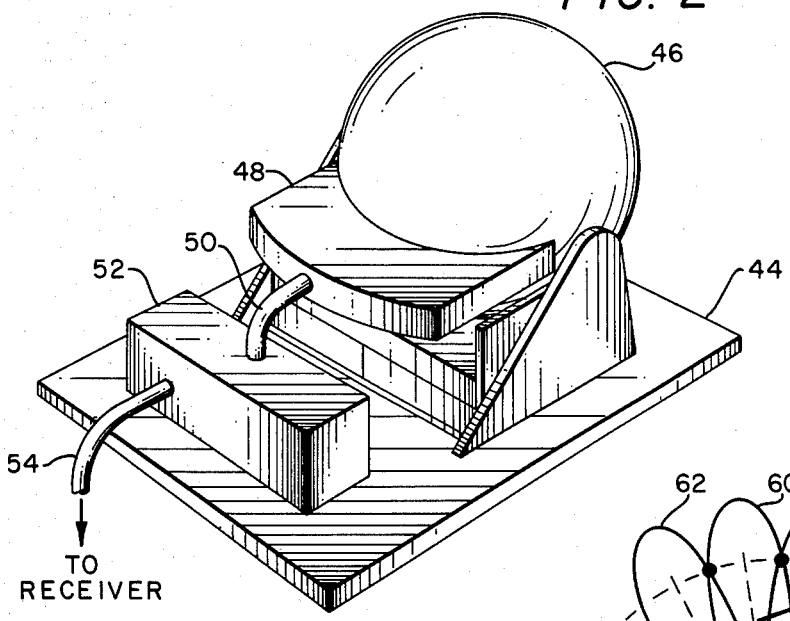
FIG. 2 is a diagrammatic representation of the antenna system in its packaged form.

FIG. 2 is a diagrammatic representation of the system of FIG. 1 in its packaged configuration. The entire unit is mounted on a platform 44 and includes a 30-inch diameter Luneberg lens 46 to which is attached the feed ports 12 and the preamplifiers (illustrated more clearly in FIG. 6) shown packaged in a container 48 in FIG. 2. The output from the feed ports 12 is conducted via cable 50 to the combining and switching circuits 52 which include the control circuit 24 and switching network 22 illustrated in FIG. 1. The output of the combining and switching circuits 52 on cable 54 are coupled to the receiver 27 which is not shown in FIG. 2. It will be noted in FIG. 2 that the feed ports 12 which are in mounting device 48 are thus mounted on or slightly removed from, the back surface of the Luneberg lens away from and on the opposite side of the signal source. A slight displacement between the lens surface and the feeds is used for the Morgan lens which is a modified version of the Luneberg lens to make the focal points fall on a spherical surface just off the lens surface to facilitate coupling to the phase center of the feed system. Thus a particular advantage of the spherical dielectric lens is that feed blockage of the aperture is eliminated since the feeds are on the back side of the aperture. Further, all feeds can be placed on focal points of the spherical lens aperture. In addition all feed beams are on the boresight of the aperture and therefore do not have the gain reduction present for off boresight side beams of phased array antennas.

Figure 3:
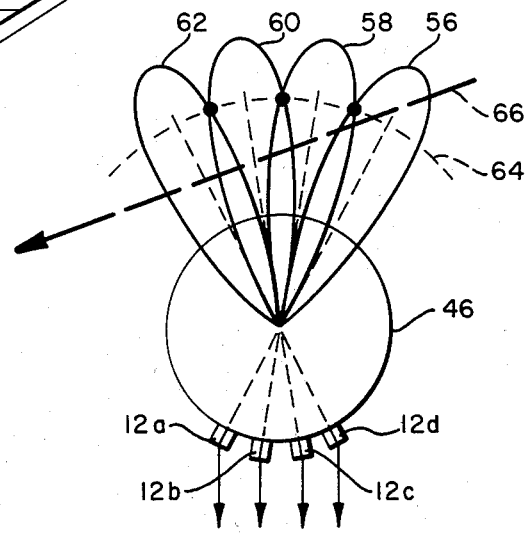
FIG. 3 is a schematic representation of a Luneberg lens having four feed ports and illustrating the beam patterns produced by said feed ports.

FIG. 3 is a diagrammatic representation of a Luneberg lens 46 having mounted thereon four feed ports 12*a*, 12*b*, 12*c*, and 12*d*. It can be seen from FIG. 3 that feed port 12*a* produces a beam pattern 56 while feed port 12*b* produces beam pattern 58, feed port 12*c* produces beam pattern 60 and feed port 12*d* produces beam pattern 62. By properly positioning the feed ports 12*a*, 12*b*, 12*c* and 12*d*, the corresponding beam patterns 56, 58, 60 and 62 overlap at the half power points as shown by arc 64.

Assuming that a spatial object such as a re-entry vehicle passes along trajectory 66 through each of said beam patterns 56, 58, 60 and 62, and assuming further that the reentry vehicle is generating signals such as telemetry signals, each of said feed ports 12*a*, 12*b*, 12*c* and 12*d* will produce an output signal as the reentry vehicle passes through its associated beam pattern.

Figure 4:
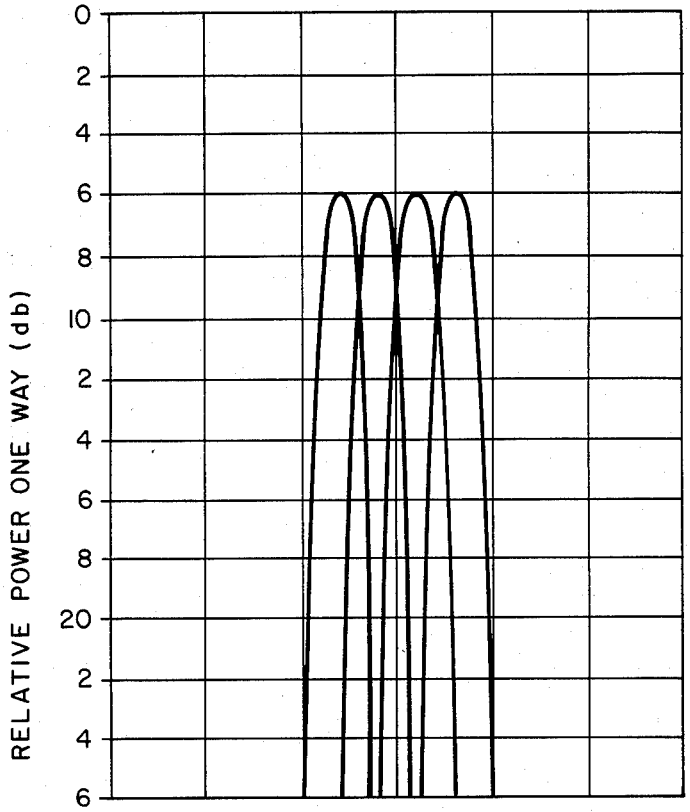
FIG. 4 is a graph representing the overlapping individual beam patterns from the feed ports in FIG. 3 wherein each feed port is individually scanned.

FIG. 4 illustrates the four individual feed patterns or beam patterns superimposed. The full gain of any one of the single beams is approximately 22 dB. The antenna pattern for each of the feed ports 12 and as shown in FIG. 3 is approximately 11° azimuth by 11° elevation.

Figure 5:
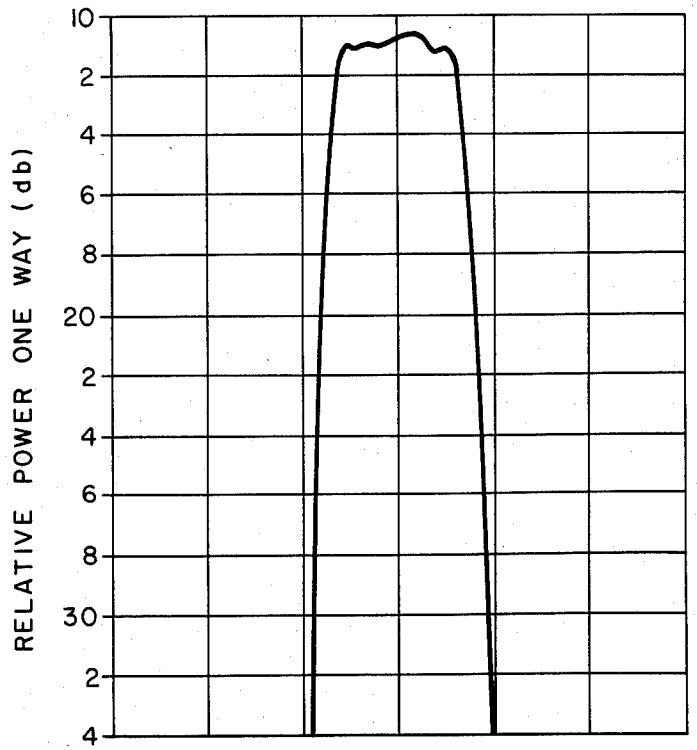
FIG. 5 is a graph illustrating an optimized four beam sum pattern wherein the output of the four feed ports shown in FIG. 3 are coherently summed to produce one beam pattern.

FIG. 5 illustrates the output produced when all four of the outputs from the feed ports 12 are combined to produce a coherently summed pattern. This pattern is approximately 11° in elevation by 44° in azimuth and, as can be seen, has a gain reduction of approximately 6 dB relative to a single feed. However, there is a fourfold increase in azimuth beam width for the power loss. To keep the gain above 20 dB, beam switching must be employed to illuminate a single beam pattern at any time and, as will be described hereinafter, a technique is used that determines in which feed port beam pattern the spatial object or target is located.

Figure 6:
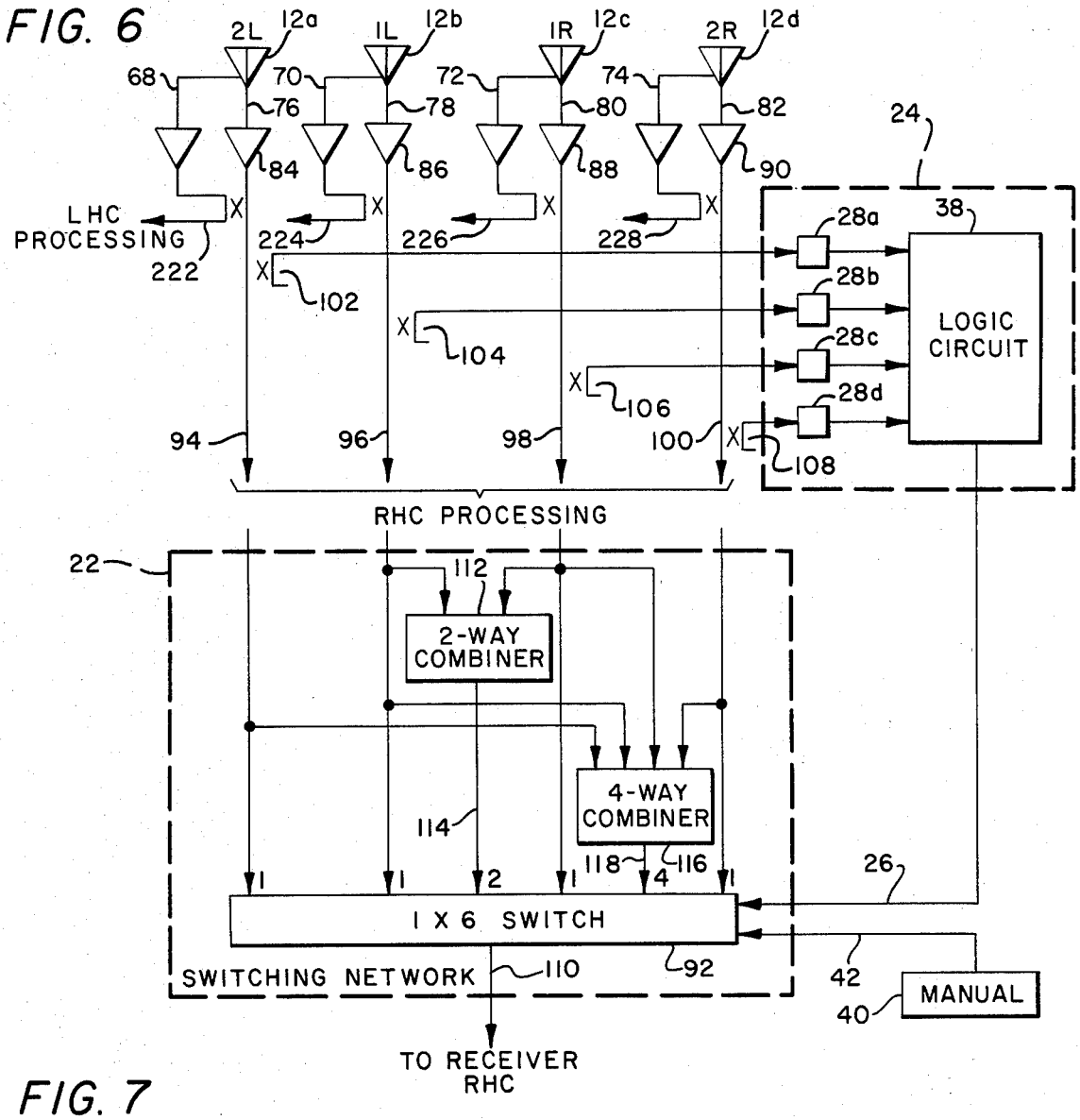
FIG. 6 is a more detailed schematic representation of the novel system illustrated in FIG. 1.

FIG. 6 is a more detailed schematic representation of the invention shown in FIG. 1. As can be seen in FIG. 6, the four feed ports 12*a*, 12*b*, 12*c* and 12*d* not only produce vertically polarized signals on lines 68, 70, 72 and 74 but also produce horizontally polarized signals on lines 76, 78, 80 and 82. The feed ports 12*a*, 12*b*, 12*c* and 12*d* are quad-ridged circular devices with orthogonal linear polarization outputs (vertical and horizontal). The horizontally polarized outputs on lines 76, 78, 80 and 82 are combined using 90° hybrid couplers with the vertical polarized outputs on lines 68, 70, 72 and 74 to form right-hand circular and left-hand circular polarized outputs. Only the right-hand circular polarized outputs are going to be discussed hereafter, but the left-hand polarized outputs can be utilized in an identical manner to be discussed later relating to the left-hand polarized circular signals to form a redundant and more efficient system.

The horizontally polarized signals on lines 76, 78, 80 and 82 are coupled to corresponding preamplifiers 84, 86, 88 and 90. Each of these preamplifiers includes low noise preamplifiers which are of the Gallium Arsenide (GaAs) FET low noise preamplifier type and a 90° hybrid coupler which is used to convert the two orthogonal polarizations to left and right-hand circular polarization. By placing the low noise amplifier 84, 86, 88 and 90 ahead of the 90° hybrid couplers 94, 96, 98 and 100, the noise figure contribution that would otherwise be associated with the insertion loss of the hybrids is substantially reduced. The low noise amplifiers are matched in gain and phase to minimize the axial ratio of the circular polarizations. The 90° hybrid couplers are old and well known in the art.

The right-hand circular polarization output from each of the hybrid couplers 84*a*, 86*b*, 88*c* and 90*d* are directly coupled to a switching network 22 via lines 94, 96, 98, and 100. Directional couplers 102, 104, 106, and 108 divert a tenth of the power from the right-hand circular polarization signal from each feed port channel 94, 96, 98 and 100 to a corresponding radiometer receiver 28 in control circuit 24. These radiometers are well known in the art and are of different types. Microwave radiometers are in extensive use in the industry. They receive microwave energy and convert it to a DC level which represents the amount of power in the energy being sampled. Thus the output of each of the radiometers 28*a*, 28*b*, 28*c* and 28*d* to the logic circuits 38 are DC levels which may be compared by logic circuit 38 to determine which of the DC levels is the highest and thus which channel being sampled is producing the greatest power. The selected output on line 26 can thus be coupled to switching network 22 to a 1 by 6 switch 92 to select the channel output on one of lines 94, 96, 98 or 100, whichever is producing the greatest power, and switch it to line 110 which is coupled to the receiver. Thus, any one of the outputs on lines 94, 96, 98 and 100 will be selected if it has the greatest power output and will be coupled via line 110 to the receiver. This enables automatic tracking of the targets to occur since, as the target passes from one beam pattern to the other as shown, for example, in FIG. 3, the feed outputs increase from one feed port 12 to the other as the vehicle passes through the corresponding lobe or beam pattern for that feed port 12. This means that the signals from a spatial object or target are automatically and continuously received from one beam pattern to the other as determined by the power output being produced by the feed port associated with the particular beam pattern in which the object is located.

A manual control circuit 40 is also coupled via line 42 to the 1 by 6 switch 92 and switching network 22. This manual control 40 allows the inhibition of the signals from the automatic tracking circuit on line 26 from control circuit 24 and enables three manual modes of operation. The first mode enables any one of the outputs from feed ports 12 on lines 94, 96, 98 and 100 to be selectively coupled via line 110 to receiver 27. The second mode allows the coherently summed and combined outputs of two of the channels such as the signals on lines 96 and 98 from feed ports 12*b* and 12*c* to be coupled to receiver 27 via line 110. These two signals on lines 96 and 98 are coupled to a two-way combiner 112 which coherently sums and combines the two signals and produces an output on line 114 which is coupled to a PIN-diode (not shown) which is activated or gated by manual control circuit 40 and is coupled via line 110 to receiver 27. The third manual mode of operation enables all of the signals on lines 94, 96, 98 and 100 from feed ports 12*a*, 12*b*, 12*c* and 12*d* respectively to be combined and summed in four-way combiner 116 which produces the coherently summed output on line 118 which is also coupled to a PIN-diode switch that is controlled by manual control circuit 40 and couples the combined coherently summed signal to receiver 27 via line 110.

The 1 by 6 switch has PIN-diodes coupled to each of the lines 94, 96, 98, 100, 114 and 118 to switch any one of those lines to receiver 27 via output line 110. PIN-diodes are well known in the art and consist of heavily doped P and N regions separated by a layer of high resistivity intrinsic material. Under zero and reverse bias, this type of diode has a very high impedance whereas at moderate forward current it has very low impedance. This permits its use as a switch in microwave transmission lines. Generally, the diode is placed in shunt across a strip line allowing unimpeded transmission when reverse biased but short circuiting the line to produce almost total reflection when forward biased by as little as one volt. The wide intrinsic layer permits high microwave peak power to be controlled since the breakdown voltage can be very high. Very little power is dissipated by the diode itself. As stated, these PIN-diodes are well known in the art and are commercially available. Such PIN-diodes switch the RF signal in 10 nanoseconds which switching time is small compared to the width of the PCM pulses received. Therefore, the receiving equipment should not miss a single bit during the automatic hand over from one feed beam to another.

The net affect of the manual control permits the operator to manually select a single beam coverage of 11° azimuth by 11° elevation, two beams combined for 22° azimuth by 11° elevation sector coverage or four beams combined for 44° azimuth by 11° elevation sector coverage. As stated earlier, the automatic mode permits full gain of each beam as a single beam, about 22 dB, to be attained and switches automatically to the RF feed containing the greatest signal power as sensed by the radiometer receivers. The two and four-way combiners are also old and well known in the art and enable RF signals to be summed coherently, or in phase.

Figure 7:
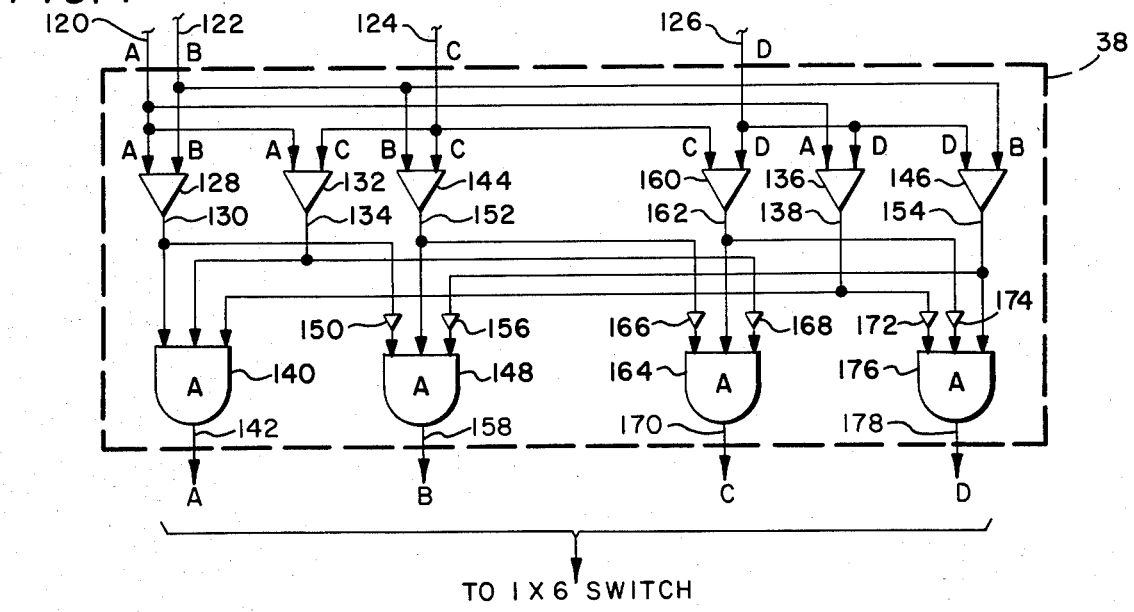
FIG. 7 is a schematic representation of the logic circuits shown in FIG. 6 which determine which feed port is producing the greatest power output.

FIG. 7 is a schematic representation of the logic circuits 38 shown in FIG. 1 and FIG. 6. Thus as can be seen in FIG. 7, the outputs from the radiometers 28*a*, 28*b*, 28*c* and 28*d* are coupled on corresponding lines 120, 122, 124 and 126 to comparators in the logic circuit 38. First, comparator 128 has as inputs the signals from lines 120 and 122 which are designated as A and B. If the signal A is greater than the signal B, comparator 128 produces an output on line 130. At the same time, the signal A is also coupled to comparator 132 where it is compared with the signal C on line 124. If the DC signal A is greater than the DC signal C then comparator 132 produces an output on line 134. In addition, the signal A is also coupled to comparator 136 along with signal D on line 126. If signal A is greater than signal D, comparator 136 produces an output on line 138. The outputs of these three comparators, 128, 132 and 136 on corresponding lines 130, 134, and 138 are coupled to AND gate 140. If all three of those signals exist, then it is obvious that signal A is larger than any of the other signals and thus AND gate 140 produces an output on line 142 indicating that signal A is larger than any of the other signals. If signal A on line 20 represents the output of coupler 108 in FIG. 6, then the output of AND gate 140 on line 142 would be coupled to the 1 by 6 switch 92 in FIG. 6 where it would bias the PIN-diode coupled to line 100 in such a way that it and only it would be coupled to the output line 110 which is connected to the receiver. This means that because the signal from feed port 12*d* is larger than the other signals, in the automatic scanning mode only its output would be coupled to the receiver.

Referring again now to FIG. 7, signal B on line 122 is compared not only to signal A but is also coupled to comparator 144 where it is compared to signal C on line 124 and is also coupled to comparator 146 where it is compared to signal D. If signal B is larger than signal A, then comparator 128 does not produce an output on line 130. However, it will be noticed that line 130 is coupled to AND gate 148 through an inverter 150. This means that if there is no output on line 130 from comparator 128, inverter 150 will produce an output as an enabling signal to AND gate 148. In addition, if signal B is larger than signal C then comparator 144 will produce an output on line 152 which is coupled directly to AND gate 148. Finally, if signal B is larger than signal D, then comparator 146 will produce no output on line 154. However, line 154 is coupled through an inverter 156 to AND gate 148. Thus if signal B is larger than all the other signals, inverter 150 and inverter 156 will both produce output signals as enabling signals to AND gate 148. In addition, comparator 144 will produce an enabling output signal on line 152 thus causing AND gate 148 to produce an output signal on line 158 designating that signal B is the largest signal. Again, in like manner as explained previously, that signal would be coupled to the 1 by 6 switch where it would so bias the appropriate PIN-diode that only the channel having B signal thereon would be coupled directly to the receiver.

Again, it will be noted that signal C is not only compared with signal A by comparator 132 and signal B by comparator 144 but is also compared to signal D by comparator 160. If signal C is larger than signal D, an output from comparator 160 will be produced on line 162 which will be coupled directly to AND gate 164. If signal C is larger than signal B, there will be no output from comparator 144 on line 152 but that line is coupled to an inverter 166 which does produce an output that is coupled as an enabling signal to AND gate 164. In like manner, if signal C is larger than signal A there will be no output from comparator 132 on line 134 but line 134 is also coupled through an inverter 168 which produces an output signal as an enabling signal to AND gate 164. Thus if signal C is larger than signals A, B, or D, AND gate 164 will produce an output signal on line 170 to be used in 1 by 6 switch 92 to gate only the channel containing signal C to the receiver on line 110.

Finally, it has been seen that signal D has been compared previously with signal A by comparator 136 and with signal C by comparator 160. In each of those cases, if signal D is greater, comparator 160 does not produce an output and comparator 136 does not produce an output. Both of these lines are coupled through inverters 172 and 174 to AND gate 176. Thus the outputs from inverters 172 and 174 are signals which serve as enabling signals to AND gate 176. Inasmuch as, in this case, signal D is greater than signal B, comparator 146 produces an output line on 154 which is coupled as the third enabling signal to AND gate 176 which produces an output signal on line 178 which, again, is used as the enabling signal to the 1 by 6 switch 92 in FIG. 6 which couples only the channel having signal D thereon through the 1 by 6 switch 92 on output line 110 to the receiver.

Thus it has been seen how the outputs of the feed ports 12*a*, 12*b*, 12*c*, and 12*d* are sampled and logic circuit 38 is used to determine which of those channels has the greatest power output and to produce a switching signal that is coupled to switching circuit 92 to gate only the feed port channel having the greatest power to the receiver thus providing automatic and continuous locating or tracking of a spatial object.

This sampling mode, however, is used only for automatic scanning of the channels and is not used in the manual mode.

Figure 8:
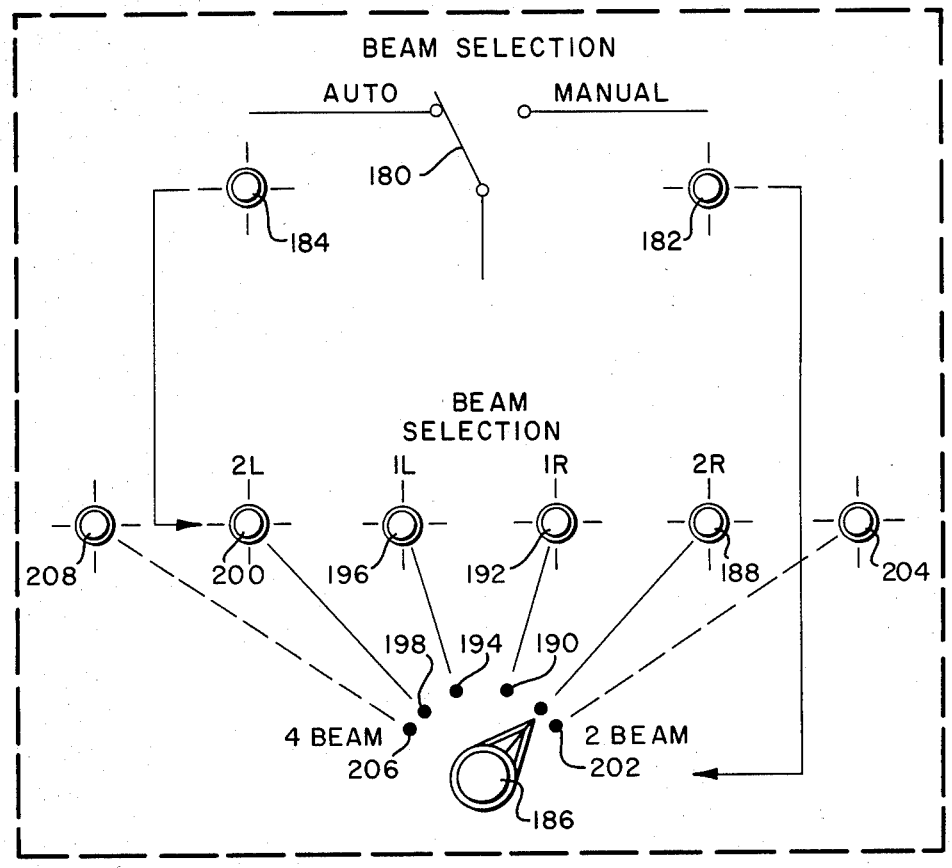
FIG. 8 is a diagrammatic representation of a control box and panel layout which enables either automatic or manual operation of the system to occur.

FIG. 8 is a diagrammatic representation of the control box in a panel layout for the novel antenna system. Beam selection between the automatic and the manual modes of operation is achieved by selector switch 180 which, when placed in the AUTO position as shown in FIG. 8, inhibits manual operation and allows only automatic scanning with the use of the control circuits 24 as illustrated and described with relation to FIG. 6. When the selector switch 180 is in the MANUAL position, the automatic scanning system is inhibited and the manual operation circuits are enabled. A light 182 is energized when switch 180 is in the MANUAL position while light 184 is illuminated when the beam selection switch 180 is in the AUTO position. When selector switch 180 is in the MANUAL position, beam selection switch 186 is enabled. When switch 186 is in the position shown, only the second beam to the right is energized and light 188 is activated. When switch 186 is in position 190, the first beam to the right is energized and light 192 is activated. In like manner, when switch 186 is in position 194, the first beam to the left is energized and light 196 is activated. When switch 186 is in position 198, the second beam to the left is energized and light 200 is activated. If it is desired to have two beams energized, coherently summed and combined simultaneously, switch 186 is placed in position 202 and light 204 is activated. If it is desired to have all four beams activated and coherently summed, switch 186 is placed in position 206 and light 208 is activated.

Figure 9:
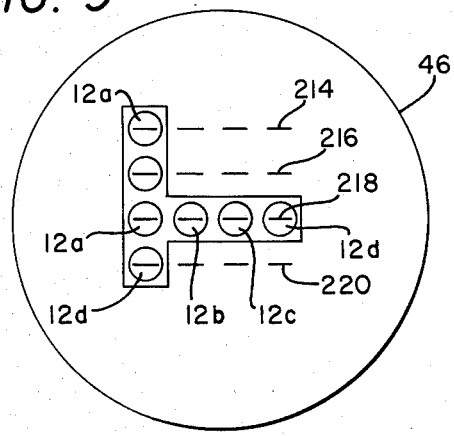
FIG. 9 is a diagrammatic representation of a Luneberg lens on which four apertures have been mounted in the horizontal plane and four apertures have been mounted in the vertical plane and in which dashed lines indicate where a plurality of horizontal rows of apertures could be mounted to obtain larger beam patterns.
Figure 10:
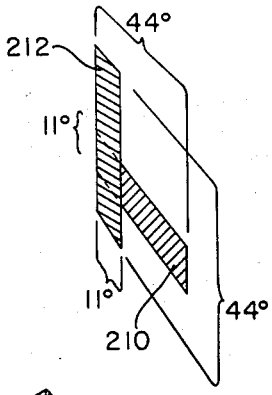
FIG. 10 is a diagrammatic representation of the beam patterns obtained with the use of both horizontal and vertical feed ports as illustrated in FIG. 9.

FIG. 9 illustrates a variety of ways in which the feed ports 12 may be mounted in relation to the Luneberg lens 46. In the operation as just described, the four ports 12*a*, 12*b*, 12*c*, and 12*d* were aligned in a horizontal plane with respect to the Luneberg lens to obtain the pattern outlined in FIG. 10 and designated by the outline 210. It can be seen that the outline of the beam coverage is 11° elevation by 44° azimuth. Each of the feed ports 12*a*, 12*b*, 12*c* and 12*d* cover a beam sector of 11° azimuth by 11° elevation. It is obvious that if the ports 12*a* through 12*d* were arranged vertically as shown in FIG. 9, a beam pattern would be obtained as illustrated in FIG. 10 by the numeral 212. Again, the beam pattern would be 11° by 44° but the 44° would lie in the elevation rather than the azimuth plane.

Figure 11:
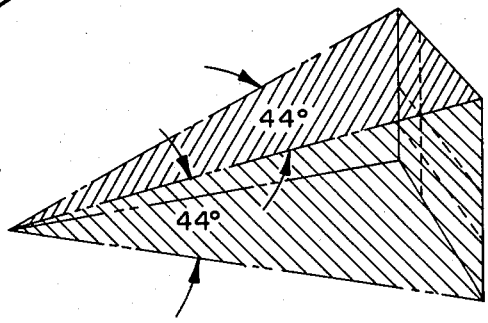
FIG. 11 is a diagrammatic representation of a beam pattern covering 44° by 44° through the use of four horizontal rows of feed ports as illustrated by the dashed lines in FIG. 9.

Of course other arrangements could be made to obtain other size beam pattern coverages. For instance, if four rows of feed ports 12*a* through 12*d* were stacked in a horizontal plane as illustrated by lines 214, 216, 218 and 220, a beam coverage of 44° azimuth by 44° elevation would be obtained as illustrated in FIG. 11. Again, in each of those cases it would be possible to automatically scan all of the outputs from the various ports and, with some added complexity in the logic circuitry compared to the one dimensional array case, select automatically that output which is greatest in order to track the target that is within that particular beam. As stated earlier, the reason for automatic scanning is because each beam operating independently has a six dB greater power amplitude than when combined. In each case, the coherent combining and summing of the various feeds causes a corresponding dB reduction.

It will also be noted with respect to FIG. 6 that the left-hand circular polarization signals 222, 224, 226, and 228 can be used to form identical redundant circuits as disclosed with respect to the right-hand circular polarization as disclosed in FIG. 6. The purpose for such redundancy is to obtain better coverage of the spatial volume in question. Beam pattern lobes are such that the signal from the spatial object may be weak in the right-handed polarization signal but strong in the left-handed polarization signal or vice versa. By using circular polarization, the search capabilities are optimized in addition to having a redundant system.

While specific embodiments of the invention have been illustrated and described, it is to be understood that these embodiments are provided by way of example only and that the invention is not to be construed as being limited thereto but only by the proper scope of the appended claims.

What I claim is:

1. A system for receiving signals from spatial objects comprising:

a. an array fed aperture antenna for producing multiple beam patterns covering a predetermined spatial volume, b. a corresponding feed port for each beam pattern coupled to said array for producing an output when a signal is generated by an object within a corresponding beam pattern, c. a receiver for receiving said antenna array feed port outputs, and d. means coupled between said antenna array feed ports and said receiver for simultaneously monitoring all feed port outputs and automatically coupled only the output of the feed port producing the greatest power to said receiver whereby automatic and continuous reception of signals from an object within said multiple beam pattern is accomplished.

2. A system as in claim 1 wherein said automatic coupling system comprises:

a. control means coupled to the outputs of each of said feed ports for simultaneously comparing said outputs for determining which of said feed ports is producing the greatest power output and generating a corresponding control signal, b. a switching network coupled between said feed ports and said receiver for selectively coupling said feed port outputs to said receiver, and c. means coupling the control signal from said control means to said switching network for enabling coupling to said receiver only said output from said feed port producing the greatest power.

3. A system as in claim 2 wherein said control means comprises:

a. means directly connected to each one of said feed port outputs and producing a DC signal level indicative of the power output, and b. logic means coupled to said DC level signal producing means for comparing said DC levels and producing an enabling signal for switching the feed port with the greatest output to said receiver.

4. A system as in claim 3 wherein said DC level producing means comprises:

a. a radiometer receiver coupled to each of said feed port outputs and producing a DC signal level indicative of the power output of the feed port to which it is coupled.

5. A system as in claim 4 wherein said switching network comprises:

a. a PIN-diode switch coupled between each of said feed port outputs and said receiver, and b. means coupling the output of said logic circuit to said PIN-diodes whereby only one of said PIN-diodes is enabled thereby coupling the output from the feed port producing the greatest power to said receiver.

6. A system as in claim 1 wherein said antenna array comprises:

a. a spherical Luneberg lens, and b. a plurality of feed ports corresponding to the number of said multiple beam patterns mounted on said lens on a spherical surface just behind the lens surface such that the beam focal points fall on said feed ports.

7. A system as in claim 6 wherein four feed ports are used to form a four beam pattern covering a spatial area of 11° by 44°.

8. A system as in claim 7 wherein:

a. said feed ports provide vertical and horizontal orthogonal linear polarization output signals, and b. means coupled to said ports for converting said orthogonal linear polarization output signals to left and righthand circular polarization signals respectively.

9. A system as in claim 8 wherein said converting means comprises an individual 90° hybrid coupler in communication with each port.

10. A system as in claim 9 further including a linear amplifier coupled between each feed port and its corresponding 90° hybrid coupler.

11. A system as in claim 10 wherein the feed port output coupled to said receiver is the right-hand circularly polarized output signal.

12. A system as in claim 11 further including:

a. a second receiver, and b. a second coupling means coupled between said antenna array and said second receiver for receiving said left-hand circularly polarized output signals and for automatically coupling said polarized output signals from the feed port producing the greatest power to said second receiver.

13. A system as in claim 1 further including:
a. a manual control circuit, and
b. means coupling said manual control circuit to said switching network and said automatic control circuit for disabling said automatic control circuit and selectively coupling predetermined combinations of said feed port outputs to said receiver thereby enabling reception of said object signals from predetermined beam patterns.

14. A system as in claim 13 further including:
a. four feed ports for producing four beam patterns and
b. means for selectively coupling any one, two or all four feed port outputs to said receiver whereby manual tracking of said object within one, two or all four of said antenna beams is accomplished.

15. A system as in claim 14 wherein said selected, predetermined, combination of feed port outputs are coherently summed before being coupled to said receiver.

16. A system as in claim 15 wherein said receiver operates in the 2200 to 2300 MHz telemetry band.

17. A system as in claim 6 wherein each of said beam patterns covers a spatial area of 11° azimuth by 11° elevation.

18. A system as in claim 6 further including:
a. four feed ports in the horizontal plane for producing a horizontal beam of 11° elevation by 44° azimuth, and
b. four feed ports in the vertical plane for producing a vertical beam of 11° azimuth by 44° elevation.

19. A system as in claim 6 further including multiple feed ports arranged in a plurality of vertically stacked horizontal rows to form a beam width of 11° times the number of horizontal ports and a beam height of 11° times the number of vertical ports.

20. A system for receiving signals from spatial objects comprising:
a. an antenna array for producing multiple beam patterns covering a predetermined spatial volume,
b. a corresponding feed port coupled to said array for each beam pattern and for producing an output when a signal is generated by an object within a corresponding beam pattern,
c. a switching network coupled to said feed ports,
d. a receiver coupled to said switching network, and
e. means coupled to said switching network for manually selecting predetermined combinations of said feed port outputs to be coupled to said receiver thereby determining the spatial volume from which signals are to be received.

21. A system as in claim 20 wherein said antenna array comprises:
a. a spherical Luneberg lens and
b. a plurality of feed ports corresponding to the number of said multiple beam patterns mounted on said lens on a spherical surface just behind the lens surface such that the beam focal points fall on said feed ports.

22. A system as in claim 21 wherein four feed ports are used to form a four beam pattern covering a spatial area of 11° elevation by 44° azimuth.

23. A system as in claim 22 wherein said switching network further includes:
a. a two-way combiner for coherently summing two of said feed port outputs, and
b. a four-way combiner for coherently summing four of said feed port outputs whereby said manual selecting means may select any one, two summed or all four summed coherent outputs to be coupled to said receiver.

24. A system as in claim 23 wherein said switching network includes PIN-diodes which may be selectively switched to couple said any one, two summed or all four summed outputs to said receiver.

25. A system as in claim 22 wherein:
a. each of said feed ports provide vertical and horizontal orthogonal linear polarization outputs, and
b. means coupled to each of said feed ports for converting said orthogonal linear polarization to left and righthand circular polarization respectively.

26. A system as in claim 25 wherein said converting means comprises an individual 90° hybrid coupler in communication with each feed port.

27. A system as in claim 26 further including a linear amplifier coupled between each feed port and its corresponding 90° hybrid coupler thereby substantially reducing the noise figure contribution otherwise associated with the insertion loss of the hybrids.

28. A system as in claim 27 wherein the feed port output coupled to said receiver is the right-hand circularly polarized output.

29. A system as in claim 28 further including:
a. a second receiver,
b. a second switching network coupled between said antenna array and said second receiver for receiving said left-hand circularly polarized outputs, and
c. a second means coupled to said second switching network for manually selecting predetermined combinations of said left-hand circularly polarized outputs to be coupled to said second receiver thereby determining the spatial volume from which said left-handed circularly polarized signals are to be received.

30. A system as in claim 1 wherein said object generated signal is of an unknown frequency in the 2200 to 2300 MHz telemetry band.

31. A system as in claim 30 wherein each of said beam patterns covers a spatial volume having a cross-sectional area of 11° azimuth by 11° elevation.

32. A system as in claim 21 further including:
a. four feed ports in the horizontal plane for producing a horizontal beam of 11° elevation by 44° azimuth, and
b. four feed ports in the vertical plane for producing a vertical beam of 11° azimuth by 44° elevation.

33. A system as in claim 21 further including multiple feed ports arranged in a plurality of vertically stacked horizontal rows to form a beam width of 11° times the number of horizontal feed ports and a beam height of 11° times the number of vertical feed ports.

34. A method of receiving signals from spatial objects comprising the steps of:
a. producing multiple beam patterns from an antenna array for covering a predetermined spatial volume,
b. producing an output signal from a corresponding feed port for each beam pattern when a signal is generated by a target within a corresponding beam, and
c. simultaneously monitoring all feed port outputs and automatically switching the output of the feed port producing the greatest power to a receiver whereby automatic and continuous reception of signals from said object within said multiple beam pattern is accomplished.

35. A method as in claim 34 wherein the step of automatically coupling the output of the feed port with the greatest power to said receiver comprises the steps of;

a. simultaneously sampling the power produced by each of said feed ports, b. simultaneously comparing said power samples to produce a signal representing which sample is greatest, and c. coupling only said output represented by said representative signal to said receiver.

36. A method as in claim 35 further including the step of mounting said feed ports on a spherical surface just behind a spherical Luneberg lens surface in a number corresponding to the number of said multiple beam patterns such that the beam focal points fall on said feed ports.

37. A method of receiving signals from spatial objects comprising the steps of:

a. producing multiple beam patterns from a Luneberg antenna array for covering a predetermined spatial volume, b. producing an output signal from a corresponding feed port for each beam pattern when a signal is generated by an object within a corresponding beam, c. simultaneously monitoring the outputs of all feed ports, and d. selectively providing an automatic mode and a manual mode of operation including:

(i) in the automatic mode automatically switching the output of the feed port producing the greatest power to a receiver whereby automatic and continuous reception of a signal from an object within said multiple beam pattern is accomplished, and (ii) in the manual mode, selectively coupling any one, two or more coherently summed feed port outputs to said receiver whereby manual reception of a signal from an object within one, two or more of said beams is accomplished.

38. An antenna system comprising:

a. an array fed spherical Luneberg lens aperture for producing multiple beam patterns covering a predetermined spatial volume, b. a corresponding feed port for each beam pattern coupled to said array for producing an output when a signal is generated by an object within a corresponding beam pattern, c. low noise amplifiers coupled to each feed port for simultaneously generating right-hand circular and left-hand circular polarized signals representing said feed port output signal, d. means for simultaneously comparing all right-hand circular polarized signals and for separately and simultaneously comparing all left-hand circular polarized signals from said amplifiers to produce first and second output control signals representing an object within a corresponding beam pattern, e. dual receivers, one of said receivers for processing right-hand circular polarized signals and the other receiver for processing left-hand circular polarized signals, and f. a switching circuit coupled between said low noise amplifiers, said dual receivers and said comparing means for coupling to said receivers only the corresponding outputs of the amplifiers producing a signal representing said feed port output signal generated by an object within a corresponding beam pattern.

39. A method of receiving signals from spatial objects comprising the steps of:

a. producing multiple beam patterns from an array fed aperture antenna for covering a predetermined spatial volume and generating output signals representing a target within a corresponding beam, b. coupling radiometer receivers covering the telemetry bandwidth to said antenna array to continuously and simultaneously monitor all signal outputs from said antenna array and generate magnitude signals for each antenna feed, c. connecting comparators to said radiometer receivers for generating signals representing the antenna feed having the greatest magnitude signal output, and d. connecting the antenna feed of said antenna array having the greatest magnitude signal output representing a target in a particular beam pattern to a receiver whereby automatic and continuous reception of signals from said object within said multiple beam pattern is accomplished.

* * * * *